US007192263B2

(12) United States Patent
Takagi

(10) Patent No.: US 7,192,263 B2
(45) Date of Patent: Mar. 20, 2007

(54) PUMP AND INK JET PRINTER MOUNTING THE PUMP

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 90 days.

(21) Appl. No.: 11/086,912

(22) Filed: Mar. 23, 2005

(65) Prior Publication Data

US 2005/0214150 A1 Sep. 29, 2005

(30) Foreign Application Priority Data

Mar. 23, 2004 (JP) ..... 2004-085430

(51) Int. Cl.

| | |
|---|---|
| ***F04C 2/00*** | (2006.01) |
| ***F04C 2/344*** | (2006.01) |
| ***F04C 15/00*** | (2006.01) |
| ***B41J 2/17*** | (2006.01) |
| ***B41J 2/175*** | (2006.01) |

(52) U.S. Cl. ..... 418/255; 418/178; 418/82; 123/235; 123/243

(58) Field of Classification Search ..... 418/255, 418/254, 178, 82; 123/235, 242, 243
See application file for complete search history.

(56) References Cited

U.S. PATENT DOCUMENTS

| | | | | |
|---|---|---|---|---|
| 1,658,524 | A * | 2/1928 | Gurley | 418/147 |
| 1,781,073 | A * | 11/1930 | Nielsen | 418/99 |
| 1,922,363 | A * | 8/1933 | Hapkins | 123/243 |
| 3,951,112 | A * | 4/1976 | Hunter | 123/242 |
| 4,333,088 | A | 6/1982 | Diggins | |
| 4,380,770 | A * | 4/1983 | Maruyama | 347/29 |
| 4,422,419 | A * | 12/1983 | Umeda | 123/235 |
| 5,613,846 | A * | 3/1997 | Sommer | 418/11 |
| 5,634,783 | A | 6/1997 | Beal | |
| 5,779,463 | A * | 7/1998 | Rossel et al. | 418/94 |
| 6,684,847 | B1 * | 2/2004 | Al-Hawaj | 123/243 |
| 2005/0214155 | A1 | 9/2005 | Takagi | |

FOREIGN PATENT DOCUMENTS

| | | | |
|---|---|---|---|
| DE | 2460949 | A * | 7/1975 |
| DE | 101 30 953 | A1 | 2/2003 |
| EP | 0 933 532 | A2 | 8/1999 |
| JP | A 59-182743 | | 10/1984 |
| JP | 1 454 755 | A1 | 9/2004 |
| JP | A 2004-268272 | | 9/2004 |
| JP | A 2004-270455 | | 9/2004 |

* cited by examiner

OTHER PUBLICATIONS

"Principles of New Machinery," Tenth Edition, 27.13 Cary's rotary pump, part 1, pp. 203, 1997.

*Primary Examiner*—Thomas Denion
*Assistant Examiner*—Mary A. Davis
(74) *Attorney, Agent, or Firm*—Oliff & Berridge, PLC

(57) ABSTRACT

The pump is provided with a housing 31, a rotor 40, and a separating member 50. Rotor 40 and separating member 50 are rotated within housing 40. Separating member 50 separates the cavity of housing 31 into a divided space 77*a*, a divided space 7*b* and a divided space 77*c*. A curved face 42 having a larger radius of curvature than rotor 40 is formed in a limited circumferential angular region at an outer peripheral surface of rotor 40. A space 43 is maintained between the curved face 42 and housing 31 even when the curved face 42 is closest to the inner face of housing 31. The space 43 forms a passage between an inlet port and an outlet port. When rotor 40 is rotated, there is a smaller degree of change in the resistance in the passage 43, and rotor 40 rotates smoothly.

7 Claims, 9 Drawing Sheets

(a)

(b)

(a)

(b)

PRIOR ART

PUMP AND INK JET PRINTER MOUNTING THE PUMP

CROSS-REFERENCE TO RELATED APPLICATION

This application claims priority to Japanese Patent Application No. 2004-085430, filed on Mar. 23, 2004, the contents of which are hereby incorporated by reference into the present application.

BACKGROUND OF THE INVENTION

1. Field of the Invention

The present invention relates to a pump provided with a housing and a rotor that rotates within the housing, the pump drawing fluid into the housing and forcing the drawn fluid to the exterior of the housing. The present invention also relates to an ink jet printer mounting this pump.

2. Description of the Related Art

Rotary pumps are known to the art. One example of a rotary pump is set forth in Principles of New Machinery, 1997, Tenth Edition, p. 203 (27.13 Cary's rotary pump, part 1) "Kikai no so Fukkan Iinkai Hensha, Rikogakusha". This pump is termed a Cary's rotary pump.

As shown in FIG. 9, a Cary's rotary pump 70 is provided with a housing 73, a rotor 74, a pair of blades (separating members) 76*a* and 76*b* and a compressed spring 75. An inlet port 71 and an outlet port 72 are formed in the housing 73. The rotor 74 is cylindrical, and has a groove 78 therein extending across its diameter. The rotor 74 rotates while making contact with a portion of an inner face of the housing 73 between the inlet port 71 and the outlet port 72. The pair of blades (the separating members) 76*a* and 76*b* are housed in the groove 78. The compressed spring 75 is housed between the pair of blades (the separating members) 76*a* and 76*b*. The compressed spring 75 presses the pair of blades (the separating members) 76*a* and 76*b* against the inner face of the housing 73.

When the rotor 74 rotates, the pair of blades 76*a* and 76*b* rotates integrally with the rotor 74 while making contact with the inner face of the housing 73. Centrifugal force operating on the pair of blades 76*a* and 76*b* increases the force pressing the pair of blades 76*a* and 76*b* against the inner face of the housing 73.

The pair of blades 76*a* and 76*b* and the rotor 74 separate a cavity within the housing 73 into three divided spaces. That is, the cavity within the housing 73 is separated into: a divided space 77*a* linked with the inlet port 71, a divided space 77*b* linked with neither the inlet port 71 nor the outlet port 72, and a divided space 77*c* linked with the outlet port 72.

When the pair of blades 76*a* and 76*b* are rotating integrally with the rotor 74, this rotation occurring in a clockwise direction, and while the pair of blades 76*a* and 76*b* are making contact with the inner face of the housing 73, the volume of the divided space 77*a* linked with the inlet port 71 increases, and the volume of the divided space 77*c* linked with the outlet port 72 decreases. The increase in volume of the divided space 77*a* linked with the inlet port 71 draws fluid such as water, air, or the like, into the housing 73 from the inlet port 71. The decrease in volume of the divided space 77*c* linked with the outlet port 72 elevates the pressure of the fluid drawn into the housing 73, and this pressurized fluid is discharged to the exterior of the housing 73 from the outlet port 72.

In the case of, for example, an ink jet printer, ink must be supplied to an ink jet head from an ink cartridge. During ordinary printing, pressure decreases in an ink passage within the ink jet head when ink is discharged from the ink jet head, and ink is consequently drawn into the ink jet head. There is no need to force ink towards the ink jet head during ordinary printing.

However, air bubbles or the like may be entrapped in the ink passage within the ink jet head when, for example, the ink cartridge has been changed. In this case, it is necessary to discharge the entrapped air bubbles or the like by forcing ink towards the ink jet head (this process is termed purging). A pump must be provided between the ink cartridge and the ink jet head for performing the purging operation.

The pump for the ink jet printer is required to force ink out through the outlet port when the pump is rotating, and required to allow ink to flow from the inlet port to the outlet port when the pump is not rotating.

However, in the conventional rotary pump 70 shown in FIG. 9, the inlet port 71 and the outlet port 72 is separated by the rotor 74 and the pair of blades 76*a* and 76*b* when the rotary pump 70 is not moving. Consequently, fluid cannot flow from the inlet port 71 to the outlet port 72 when the rotary pump 70 is not moving.

It is possible to maintain a passage between the inlet port 71 and the outlet port 72 by forming a cut-away portion in an outer peripheral surface of the rotor 74 of the rotary pump 70 shown in FIG. 9. This allows a pump 70 to be realized in which fluid flows from a supply source to a supply destination even when the pump 70 is not moving.

This type of rotary pump is disclosed in Laid-Open Japanese Patent Application Publications 2004-268272 and 2004-270455. The pump disclosed in these publications comprises the rotor having the cut-away portion in its outer peripheral surface, and the passage from the inlet port to the outlet port is maintained when the pump is halted.

SUMMARY OF THE INVENTION

However, if the cut-away portion in the outer peripheral surface of the rotor 74 is not formed appropriately, the rotor tends to rotate unevenly. In particular, when a synchronous motor, such as a stepping motor, is used to drive the rotation of the rotor, the uneven rotation of the rotor 74 may cause the motor to become out of step.

Further, there is a risk that the shape of the cut-away portion may result in a high resistance in a passage formed by the cut-away portion. Consequently, the quantity of fluid supplied from the supply source to the supply destination might be insufficient.

The pump disclosed in Laid-Open Japanese Patent Application Publications 2004-268272 and 2004-270455 has the cut-away portion extending in a flat plane, and the plane cut-away portion tends to generate uneven rotation of the rotor.

An object of the present invention is to present a pump which does not prevent the fluid from flowing from an inlet port to an outlet port when the pump is not rotating, and moreover which suppresses uneven rotation of a rotor.

A further object of the present invention is to present a pump in which pump efficiency is high, and moreover in which, when the pump is halted, resistance is low in a passage between an inlet port and an outlet port.

Yet another object of the present invention is to present an ink jet printer provided with this pump.

A pump of the present invention comprises a housing, a rotor, and a separating member.

The housing has a cylindrical wall, a bottom wall provided at one end of the cylindrical wall, and a top wall provided at the other end of the cylindrical wall. An inlet port and an outlet port are formed in the cylindrical wall. A cylindrical cavity is formed within the housing. The rotor and the separating member are installed within the housing and the separating member is rotated with the rotor. An edge of the separating member is in contact with an inner face of the housing. The separating member separates the inner cavity of the housing into a plurality of divided spaces, and the edge of the separating member slides along the inner face of the housing while the separating member is being rotated with the rotor. In the pump of the present invention, a curved face having a larger radius of curvature than the rotor is formed in a limited circumferential angular region at an outer peripheral surface of the rotor.

Fluid is drawn into the housing from the inlet port, and the fluid that has been drawn is discharged from the outlet port while the rotor is rotating within the housing.

Since the curved face having the larger radius of curvature than the rotor is formed in a limited circumferential angular region at the outer peripheral surface of the rotor, a space is maintained between the curved face and the housing even when the curved face is closest to the inner face of the housing between the inlet port and the outlet port. This space forms a passage. By maintaining the passage between the inlet port and the outlet port, it is possible to obtain a rotary pump in which the fluid flows without hindrance from the inlet port to the outlet port.

The cut-away portion that forms the passage between the inlet port and the outlet port is formed as a curved face. Consequently, when there is a change in the rotational position of the rotor (the rotational angle of the rotor), there is a smaller degree of change in the resistance in the passage, and the rotor rotates smoothly. Consequently, the motor driving the rotation of the rotor does not readily become out of step. The rotor can rotate at high speed since it is rotating smoothly, and a pump with a high output can be obtained. Further, the resistance in the passage—this passage being formed in the space between the curved face of the rotor and the inner face of the housing when the curved face and the inner face are closest—is smaller, and consequently the fluid can flow smoothly from the inlet port to the outlet port.

It is preferred that portions where the outer periphery of the rotor and the curved face intersect are formed in a curved face shape. It is preferred that the outer periphery of the rotor (referred to as the portion not provided with the curved face having the larger radius of curvature) and the curved face join smoothly together in the curved face shape. As a result, there is a smaller degree of change in the resistance in the passage when there is a change in the rotational position of the rotor, and the rotor thus rotates even more smoothly. The rotor can be rotated at high speed without increasing motor output.

It is preferred that when the radius of curvature of the curved face is r, and the radius of curvature of the rotor is R, $1.1<r/R<1.3$.

If the ratio between the radius of curvature r of the curved face and the radius of curvature R of the rotor is within the above range, there is a smaller degree of resistance in the passage—this passage being formed in the space between the curved face of the rotor and the inner face of the housing when the curved face and the inner face are closest. Consequently, the fluid can flow smoothly from the inlet port to the outlet port. Moreover, the degree of change in the resistance in the passage, relative to change in the rotational position of the rotor, can be suppressed to be within a permitted range.

It is preferred that the curved face is formed in a concave shape at a part-way portion (middle portion) in the outer peripheral surface of the rotor in the axial direction of the rotor.

In this case, both ends of the rotor in the axial direction have complete circular cross-sections and make contact stably with the inner face of the housing. The rotor can rotate under a condition that the rotor is guided by the housing, therefore, the rotor can rotate at high speed without increasing motor output.

It is preferred that corner portions between the concave shape having the larger radius of curvature and the circular outer surface of the rotor at both ends are formed, when observed in a cross-section that includes a rotary shaft of the rotor, with a prescribed radius of curvature.

In this case, contact resistance between the rotor and the housing is reduced, and consequently the rotor can rotate at high speed.

When the pump of the present invention is mounted in an ink jet printer in which the inlet port of the pump is linked with an ink cartridge, and the outlet port of the pump is linked with an ink jet head, the ink jet printer can be obtained in which ink is forced outwards from the outlet port and the purge operation is thus performed when the pump operates, and in which ink flows from the inlet port to the outlet port even in the case where the pump is not rotating, and printing can thus be performed. The rotor can be rotated at high speed even with a low-output motor, and an improved purging operation can thus be realized.

BRIEF DESCRIPTION OF THE DRAWINGS

FIG. 3(*a*) shows a cross-sectional view showing a state where a cover member has not been fixed to a housing member, and FIG. 3(*b*) shows a cross-sectional view showing a state where the cover member has been fixed to the housing member.

FIG. 4(*a*) shows a case where intersecting portions are not formed in a curved face shape, and FIG. 4(*b*) shows an enlargement of a vicinity of the intersecting portions where a curved face shape is formed.

FIG. 6(*a*) shows the pump in a halted state, FIG. 6(*b*) and FIG. 6(*c*) show the pump in a rotating state.

FIG. 8(*a*) shows a case where a curved face is formed across a range of 80° of the rotor, and FIG. 8(*b*) shows a case where the curved face is formed across a range of 40° of the rotor.

DETAILED DESCRIPTION OF THE INVENTION

Preferred Embodiments to Practice the Invention

A preferred embodiment for practicing the present invention will now be described. In the present embodiment, the present invention has been applied to a line type color ink jet printer.

Figure 1:
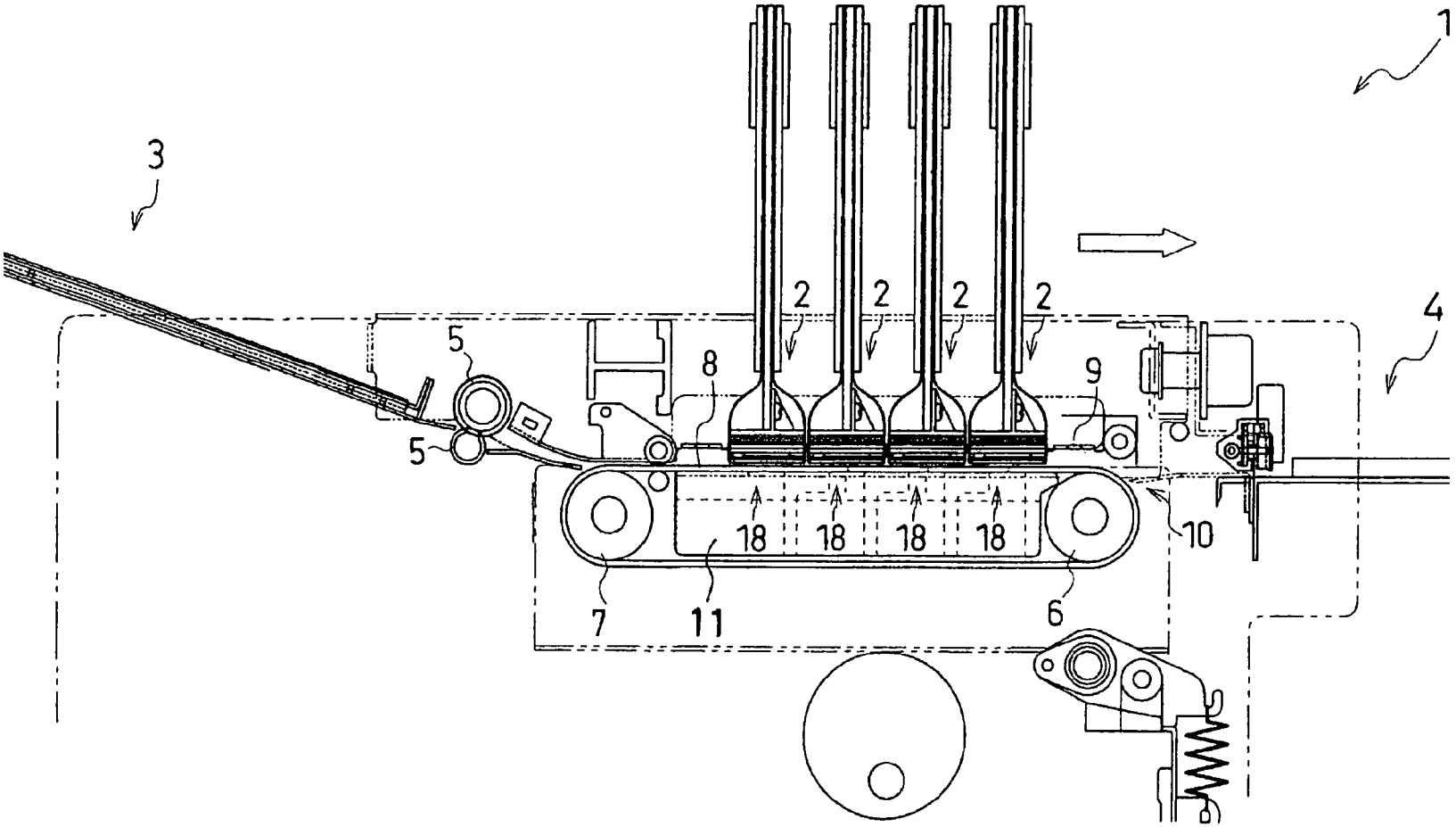
FIG. 1 shows a side view of an embodiment of an ink jet printer of the present embodiment.

As shown in FIG. 1, a color ink jet printer 1 has four ink jet heads 2. The ink jet printer 1 is provided with a paper delivery part 3 and a paper discharge part 4 at the left and right side respectively relative to FIG. 1. A paper carrier path is formed within the ink jet printer 1 between the paper delivery part 3 and the paper discharge part 4.

A pair of upper and lower delivery rollers 5 is disposed downstream from the paper delivery part 3. Paper (a recording medium) is held between these delivery rollers 5 and is delivered. The delivery rollers 5 deliver the paper from left to right relative to FIG. 1. The paper carrier path has two belt rollers 6 and 7 disposed therein, and an endless carrier belt 8 is wound between the belt rollers 6 and 7. Silicon processing has been performed on an outer face (a carrier face) of the carrier belt 8, and consequently the paper carried thereto by the pair of delivery rollers 5 remains on a surface face of the carrier belt 8 by means of adhesive force. The belt roller 6 is driven by motor not shown, thus carrying the paper downstream (towards the right) by means of the carrier belt 8. A pressing member 9 is located at a side opposite the belt roller 6 (the opposite side relative to the paper carrier path). The pressing member 9 presses the paper onto the carrier belt 8 so that the paper does not rise off the carrier face.

A lifting mechanism 10 is formed to the right, relative to FIG. 1, of the carrier belt 8. The lifting mechanism 10 lifts off the paper adhering to the carrier face of the carrier belt 8 and delivers it to the paper discharge part 4 at the right side. Further, a guide member 11 is disposed at an inner side of the carrier belt 8 at a location opposite the ink jet heads 2. That is, the guide member 11 makes contact with a lower face of an upper half of the carrier belt 8 and supports this carrier belt 8 from its inner circumference side. The guide member 11 has a rectangular parallelopiped shape.

The ink jet heads 2 are long along a direction orthogonal to the page of FIG. 1, and are rectangular from a plan view. Each ink jet head 2 corresponds to one of four colors of ink (magenta, yellow, cyan, and black) and the ink jet heads 2 are aligned so as to extend in the direction of delivery of the paper. A head main body 18 is provided at a lower end part of each ink jet head 2. The head main body 18 contains an ink passage unit and an actuator provided at a surface face of the ink passage unit. The ink passage unit is formed from an ink passage that includes a pressure chamber. The actuator elevates the pressure of ink within the pressure chamber. A plurality of nozzles is formed at lower faces of the head main bodies 18. These nozzles are linked with the ink passages in the head main bodies 18, and discharge ink towards the paper delivered by the carrier belt 8.

A minute space is formed between lower faces of the ink jet heads 2 and the carrier face of the carrier belt 8. This space forms the paper carrier path. When the paper is passed though this space between the four ink jet heads 2 and the carrier belt 8, ink of each color is discharged from the nozzles to an upper face (a printing face) of the paper. The desired color image is thus formed on the paper.

Next, an ink supply system for supplying ink to the ink jet heads 2 will be described with reference to FIG. 2.

Ink cartridges 20 for storing ink to be supplied to the ink jet heads 2 are mounted in the ink jet printer 1. Four ink cartridges 20 corresponding to the four ink colors (magenta, yellow, cyan, and black) are mounted.

Each ink cartridge 20 and each ink jet head 2 is linked via a pump 30 and a resilient tube 13. The tube 13 is formed from elastomer, and has considerable elasticity.

Figure 2:
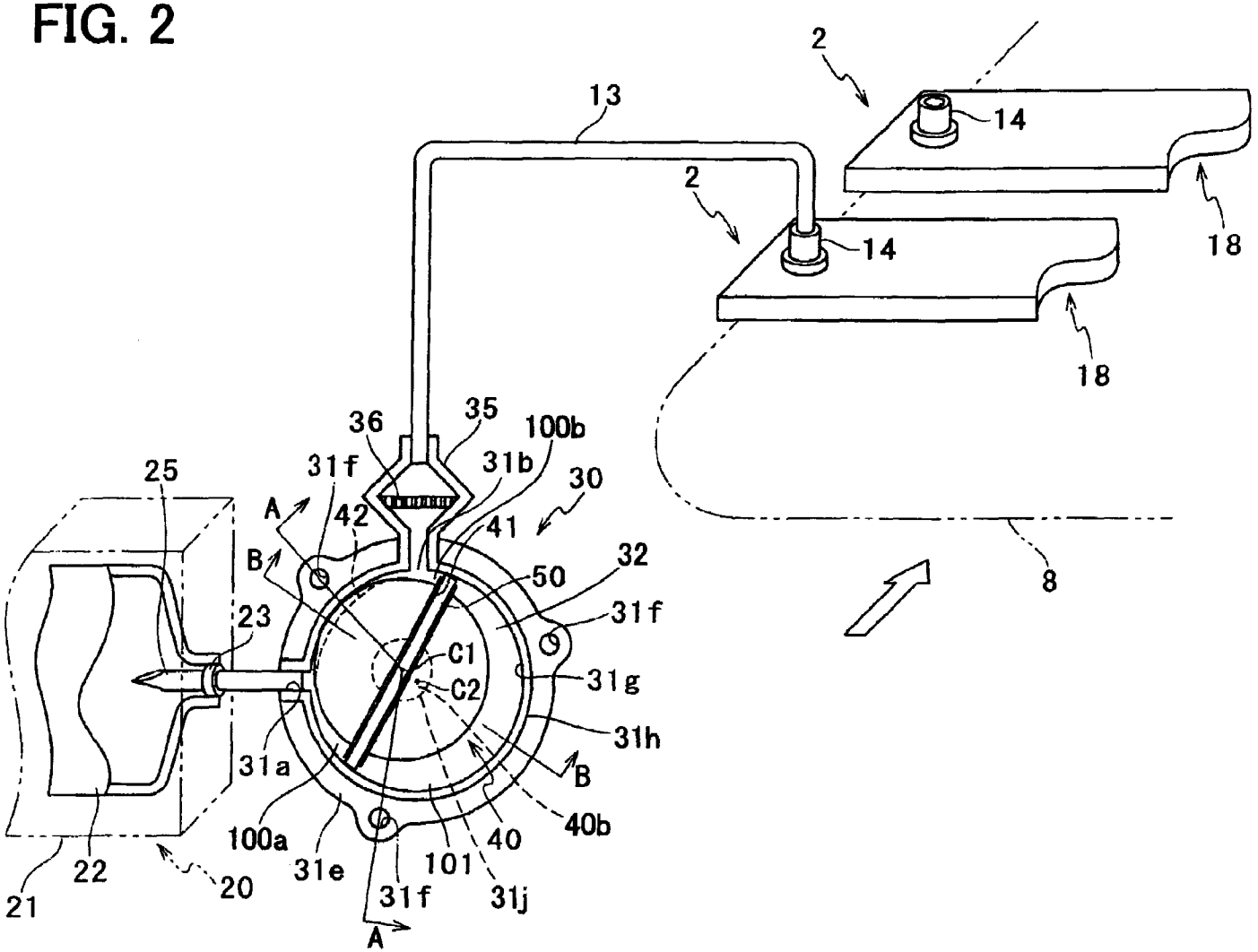
FIG. 2 shows a schematic block diagram of a ink supply system of the ink jet printer.

FIG. 2 shows only one ink cartridge 20, pump 30, and tube 13, these corresponding to one ink jet head 2. However, there are in fact four sets including the ink cartridge 20, pump 30, and tube 13.

As shown in FIG. 2, the ink cartridge 20 is provided with a cartridge main body 21 and an ink sack 22. The cartridge main body 21 is formed from synthetic resin. The ink sack 22 is provided within the cartridge main body 21. The ink sack 22 comprises a pouch film formed by thermo compression bonding a plurality of resilient films. Deaerated ink is stored in the ink sack 22. A polypropylene film is formed at an innermost side of the pouch film, a polyester film is formed at an outer side thereof, followed by an aluminum foil film, and then a nylon film. A resin spout is formed in the ink sack 22 for sealing an opening part thereof. This spout is provided with a cap 23 formed from silicone rubber or butyl rubber. When a hollow needle 25 (to be described) passes through the cap 23, the ink in the ink cartridge 20 is supplied to the ink jet head 2 via the pump 30 and the tube 13. Moreover, when the ink within the ink cartridge 20 has finished, the hollow needle 25 is removed from the cap 23, and the ink cartridge 20 can be exchanged.

A cylindrical ink supply port 14 is formed at an upper face of one end, relative to its longitudinal direction, of the head main body 18 of the ink jet head 2. One end of the tube 13 is connected with the ink supply port 14. The other end of the tube 13 is connected with the pump 30.

When the ink cartridge 20 is exchanged, air bubbles, etc. may be entrapped in the ink passage within the head main body 18. The pump 30 is operated so as to force the ink in the ink jet head 2 outwards, and thus discharge from the nozzles (i.e. purge) the air bubbles or the like trapped in the ink. It is necessary, in the purging operation, to discharge the air bubbles effectively while minimizing the quantity of ink wasted. The ink must therefore be forced outwards using a high current speed.

During printing, the actuator of the head main body 18 is operated and the ink is discharged. Discharging the ink decreases the pressure in the ink passage within the head main body 18, thus drawing ink into this ink passage. Since ink feeds into the head main body 18 during printing, there is no need to operate the pump 30. A passage 43 (see FIGS. 3(*a*) and (*b*), and FIG. 4(*a*)) is formed within the pump 30 to allow the passage of ink when the pump 30 is not rotating. During printing, when the pump 30 is in a halted state, the ink in the ink cartridge 20 passes through the pump 30 and the tube 13, passes through the ink passage formed in the head main body 18, and is discharged from the nozzle.

Figure 3:
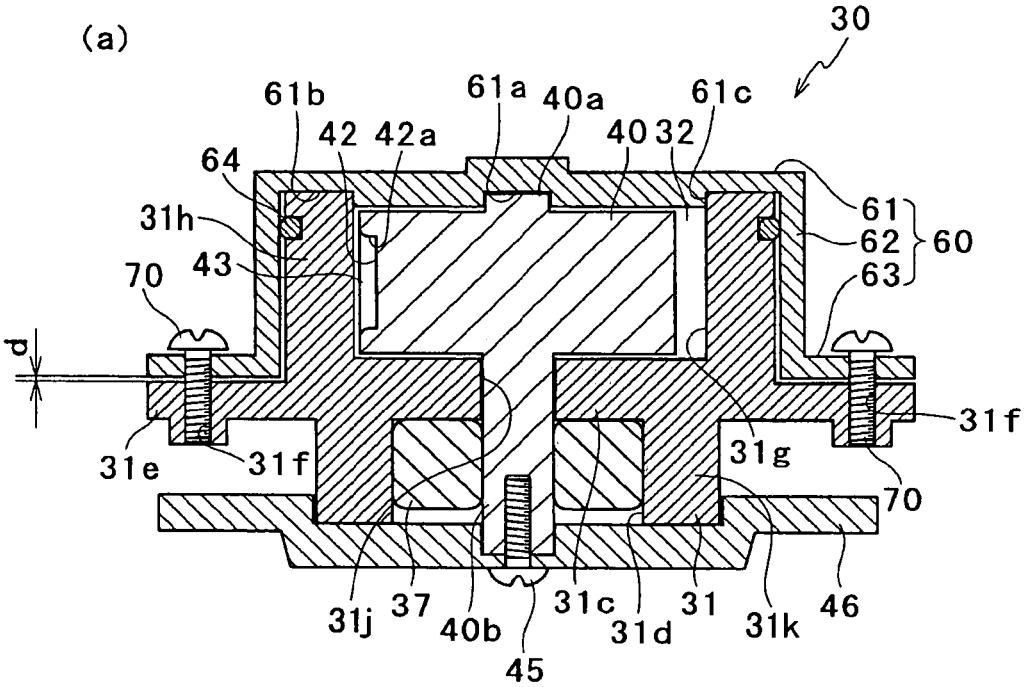
FIG. 3 shows cross-sectional views along the line A-A of the pump shown in FIG. 2.
Figure 3:
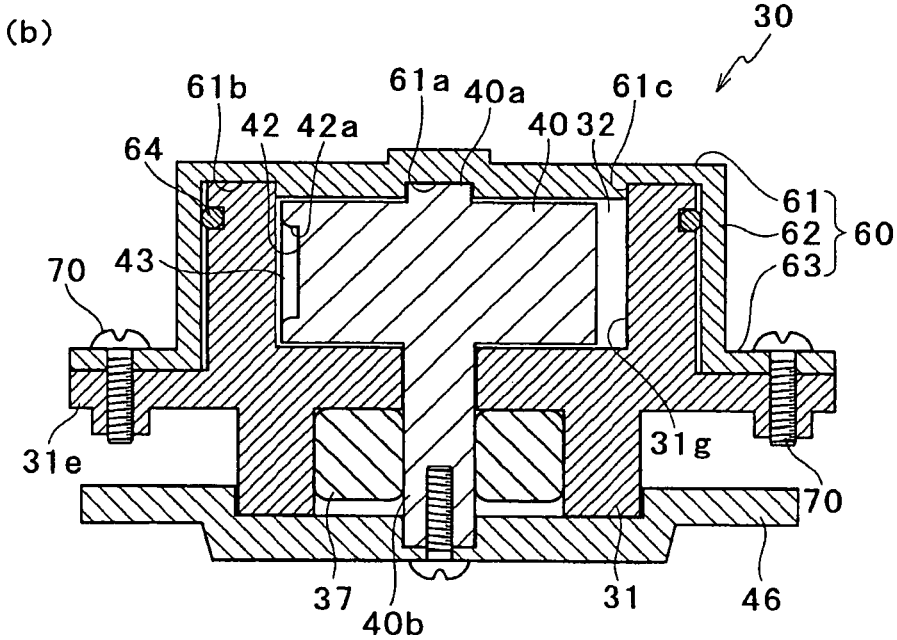

Next, the pump 30 will be described in detail. As shown in FIGS. 3(*a*) and (b), the pump 30 is provided with a housing member 31 (first housing member), a cover member 60 (second housing member), a rotor 40, a separating member 50, and screws 70 (fixing means). The pump 30 in FIG. 2 is shown in a state in which the cover member 60 has been removed. Furthermore, FIG. 3(*a*) is a cross-sectional view along the line A—A of FIG. 2 showing a state where the cover member 60 is not fixed to the housing member 31. FIG. 3(*b*) is a cross-sectional view along the line A—A of FIG. 2 showing a state where the cover member 60 is fixed to the housing member 31.

The housing member 31 is injection molded from synthetic resin. The housing member 31 has the following: a cylindrical wall 31*h* having a cavity 32 therein, an inlet port 31*a* and an outlet port 31*b* that pass through the cylindrical wall 31*h* (see FIG. 2), a base 31c formed at a lower end of the cylindrical wall 31*h*, a fixing part 31*e* that extends horizontally in a collar shape from the base 31*c*, and a cylindrically-shaped wall 31*k* that extends downwards from the base 31*c*. An upper end of the cylindrical wall 31*h* is open.

The inlet port 31*a* is formed in the cylindrical wall 31*h* of the housing member 31 at a location opposite the cap 23 of the ink cartridge 20. The hollow needle 25, which is made from metal, fits into the inlet port 31*a*. The inlet port 31*a* is linked with the ink cartridge 20 via this hollow needle 25. The end of the hollow needle 25 at its ink cartridge 20 side is sharp and has been cut obliquely. As shown in FIG. 2, the hollow needle 25 fitted into the inlet port 31*a* passes through the cap 23 of the ink cartridge 20, and the ink in the ink cartridge 20 is drawn, via the hollow needle 25, from the inlet port 31*a* into the cavity 32.

The outlet port 31*b* is formed in the cylindrical wall 31*h* of the housing member 31 at a location approximately 270°, in an anticlockwise direction of FIG. 2, from the inlet port 31*a* (located at an upper end of the housing member 31 in FIG. 2). A filter housing part 35 is formed integrally with the housing member 31. The filter housing part 35 is linked with the outlet port 31*b* and houses a filter 36. One end of the tube 13 is connected with the filter housing part 35. The outlet port 31*b* is thus linked with the ink jet head 2 via the filter housing part 35 and the tube 13. The filter housing part 35 has a diamond shape in vertical cross-section, and a mesh-shaped filter 36 is housed therein. The filter 36 filters the ink being supplied from the ink cartridge 20 to the ink jet head 2. The filter 36 captures and removes from the ink, for example, rubber residue that is created when the hollow needle 25 is pushed through the cap 23 or when the hollow needle 25 is removed therefrom at the time when the ink cartridge 20 is attached or removed. It is no longer necessary to provide a filter at the ink cartridge 20 side, and the configuration of the ink cartridge 20 can thus be simplified.

The base 31*c* is formed at the lower end of the cylindrical wall 31*h* of the housing member 31. A shaft receiving hole 31*j* is formed in the base 31*c*. The shaft receiving hole 31*j* receives a rotating shaft 40*b* at a lower side of the rotor 40 (to be described). In FIG. 2, the shaft receiving hole 31*j* is formed at an off-center location extending obliquely upwards and to the left from a center C2 of the cavity 32.

As shown in FIG. 3, the fixing part 31*e* that extends horizontally in a collar shape to an outer side of the cylindrical wall 31*h* is formed at the same height as the base 31*c*. As shown in FIG. 2, screw holes 31*f* are formed at three equidistant locations along the circumference of the fixing part 31*e*.

The housing member 31 is provided with the cylindrically-shaped wall 31*k* that extends downwards from the base 31*c*. An oil seal 37 is housed within the cylindrically-shaped wall 31*k*.

The rotor 40 is formed in a cylindrical shape and is somewhat shorter in the axial direction (the up-down direction of FIG. 3) than the cavity 32. Rotating shafts 40*a* and 40*b* are formed integrally at an upper and a lower end (relative to FIG. 3) respectively of the rotor 40. The upper rotating shaft 40*a* is supported in a manner allowing rotation in a concave shaft receiving member 61*a* formed in a sealing portion 61 of the cover member 60 (to be described). The lower rotating shaft 40*b* is inserted into, and supported in a manner allowing rotation, in the shaft receiving hole 31*j* formed in the base 31*c* of the housing member 31. Both upper and lower ends of the rotor 40 are supported in a manner allowing rotation and the rotor 40 can rotate freely within the cavity 32 of the housing member 31. As shown in FIG. 2, a rotational center C1 of the rotor 40 is in an off-center location obliquely upwards and to the left from the center C2 of the cavity 32. An outer peripheral surface of the rotor 40 (in fact, a portion of the outer peripheral surface that does not have a curved face 42, to be described) makes contact with an inner face 31*g* of the cylindrical wall 31*h* of the housing member 31 at a location downstream from the outlet port 31*b* and upstream from the inlet port 31*a* (upstream and downstream in relation to an anticlockwise direction of the rotor, this rotor rotating in the anticlockwise direction relative to FIG. 2).

As shown in FIG. 3, a gear 46 is fixed by means of a screw 45 to a lower end of the rotating shaft 40b. The gear 46 is connected with a driving motor (not shown) that consists of a stepping motor. Driving force of the driving motor is transmitted to the rotating shaft 40*b* via the gear 46, thus driving the rotation of the rotor 40.

The oil seal 37 is provided between the rotating shaft 40*b* and the housing member 31. The oil seal 37 prevents lubricating oil applied to the gear 46, etc. from entering into the cavity 32. Furthermore, the oil seal 37 prevents the ink within the cavity 32 from leaking to the exterior.

Figure 4:
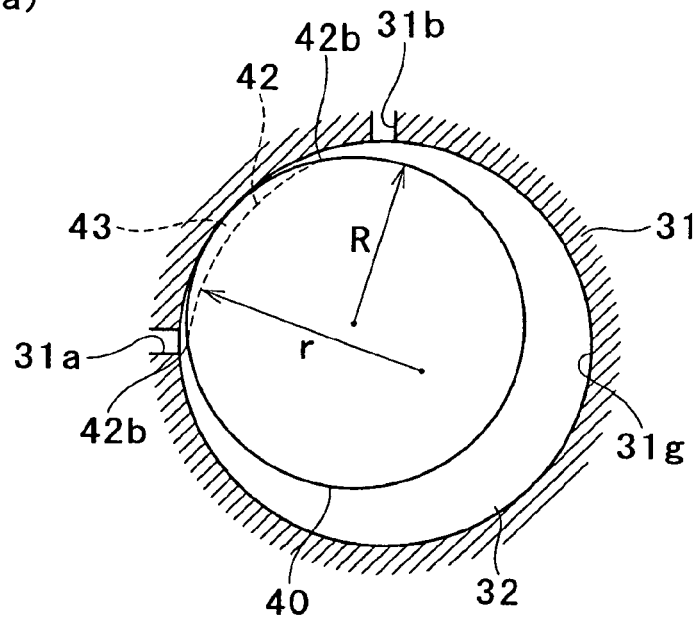
FIG. 4 shows schematic views of a rotor provided with a curved face.
Figure 4:
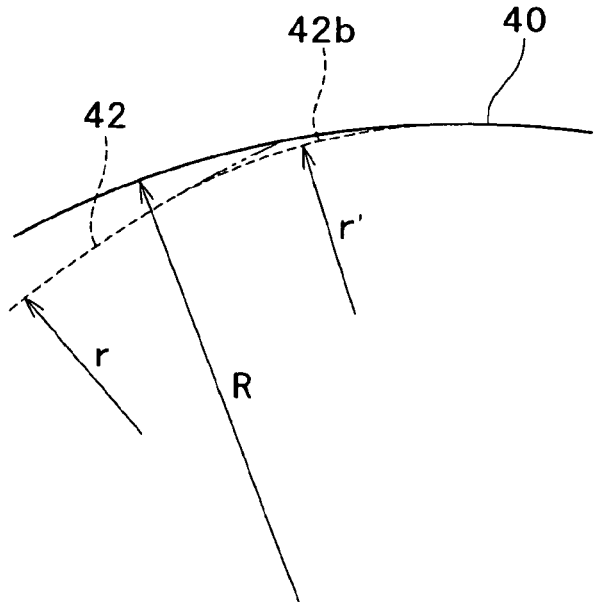

As shown in FIGS. 2 to 4, the curved face 42 that has a larger radius of curvature than the rotor 40 is formed at a limited circumferential angular region of an outer peripheral surface of the rotor 40. The pump 30, when it is to be halted, is halted by means of the stepping motor with the rotor being at an angle such that the curved face 42 faces the inner face 31*g* of the housing member 31 at a position that is downstream from the outlet port 31*b* and upstream from the inlet port 31*a* (see FIG. 4(*a*) and FIG. 6(*a*)). When the pump 30 is in the halted state, a passage 43 is formed between the curved face 42 of the rotor 40 and the inner face 31*g* of the housing member 31. The passage 43 links the inlet port 31*a* and the outlet port 31*b*.

The passage 43 links the ink cartridge 20 and the ink jet head 2 when the pump 30 is not being driven. When paper is to be printed, ink is delivered from the ink cartridge 20 to the ink jet head 2 even when the pump 30 is not moving.

As shown in FIG. 3, the curved face 42 is formed at a part-way portion (middle portion) in the outer peripheral surface of the rotor 40 in the axial direction of the rotor 40. The upper and lower ends of the rotor 40 are complete circular in their cross sections. The curved face 42 forms a concave shape between the upper and lower ends of the rotor 40. While rotating, the upper and lower ends of the rotor 40 continually make contact with the inner face 31*g* of the housing member 31. This inner face 31*g* guides the upper and lower ends of the rotor 40. As a result, the rotor 40 can rotate smoothly at high speed.

As shown in FIG. 3, angled portions 42*a* (stepped or corner portions) of the concave shape of the curved face 42 of the rotor 40 are formed—observed from a cross-section that includes a rotary shaft of the rotor 40—with a prescribed radius of curvature. Contact resistance between the rotor 40 and the housing member 31 is thus reduced.

The amount of force required to rotate the rotor 40 by a unit angle changes depending on the angle of rotation of the rotor 40. The curved face 42 is formed in the concave shape in the outer peripheral surface of the rotor 40 along a limited divided region of the circumference direction thereof. The angle of the outer peripheral surface of the rotor 40 having the curved face 42 with respect to the housing member 31 is thus changed, and the amount of force required to rotate the rotor is thus changed also.

As shown in FIG. 4(*b*), it is preferred that the portions 42*b*, where the outer peripheral surface of the rotor 40 and the curved face 42 intersect, are smoothly joined by a curved face having a prescribed radius of curvature r'. In FIG. 4(*b*), a state in which the intersecting portions 42*b* are not formed in a curved face shape is shown by a two-dot chain line. The smooth join between the outer peripheral surface of the rotor 40 and the curved face 42 suppresses the degree of change of the force for rotating the rotor 40, and consequently the rotor 40 rotates smoothly.

Figure 5:
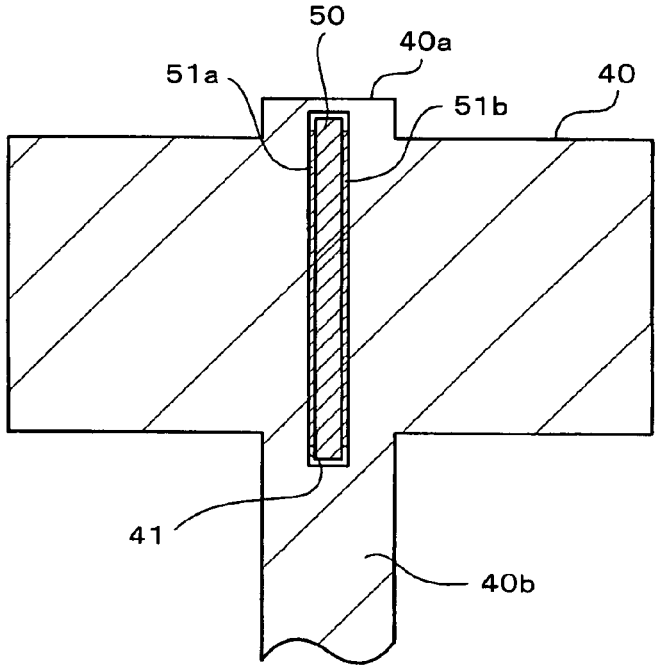
FIG. 5 shows a cross-sectional view along the line B—B of the rotor shown in FIG. 2.

As shown in FIGS. 2 and 5, a retaining groove 41 for retaining the separating member 50 passes in a radial direction through the rotor 40. The retaining groove 41 also passes through the rotor 40 in the axial direction, extends to the rotating shafts 40*a* and 40b, and is exposed at both axial end faces of the rotor 40 except the rotating shafts 40*a* and 40*b*.

The separating member 50 and two sliding members 51*a* and 51*b*, these having the separating member 50 sandwiched therebetween, are inserted in an overlapping state into the retaining groove 41. The separating member 50 is formed from synthetic rubber EPDM (ethylene propylene diene terpolymer), and is resilient. The sliding members 51*a* and 51*b* are formed from POM (polyoxymethylene) resin, and have a low coefficient of friction with respect to both the separating member 50 and the rotor 40. The separating member 50 that is sandwiched between the two sliding members 51*a* and 51*b* is located within a plane that includes the center C1 of the rotor 40, and rotates integrally with the rotor 40.

The separating member 50 has a rectangular plane shape. As shown in FIG. 2, when the separating member 50 has been inserted into the retaining groove 41, the separating member 50 projects in a radial direction beyond the outer peripheral surface of the rotor 40, and its protruding ends make contact with the inner face 31*g* of the housing member 31. The elasticity of the separating member 50 presses the protruding ends of the separating member 50 against the inner face 31*g*.

The separating member 50 also protrudes in the axial direction of the rotor 40 from the end face (relative to the axial direction) of the rotor 40. A lower protruding end of the separating member 50 makes contact with the base 31*c* of the housing member 31, and an upper protruding end thereof makes contact with the cover member 60. The elasticity of the separating member 50 presses its protruding lower end against the base 31*c* and presses its protruding upper end against an inner face of the cover member 60.

As shown in FIG. 2, a cavity 32 within the housing member 31 is separated by the separating member 50 and the rotor 40 into: a divided space 100*a* linked with the inlet port 31*a*, a divided space 101 linked with neither the inlet port 31*a* nor the outlet port 31*b*, and a divided space 100*b* linked with the outlet port 31*b*. The separating member 50 protrudes in the radial direction beyond the outer peripheral face of the rotor 40, and makes contact with the inner face 31*g* of the housing member 31. Furthermore, the separating member 50 protrudes in the axial direction beyond the axial end faces of the rotor 40, and makes contact with the base 31*c* of the housing member 31 and the inner face of the cover member 60. An outer peripheral portion of the rotor 40 that is not provided with the curved face 42 makes contact with the inner face 31*g* of the housing member 31 between the inlet port 31*a* and the outlet port 31*b*.

Ink can reliably be prevented from leaking between the divided spaces 100*a*, 101, and 100*b* which are separated by the rotor 40 and the separating member 50.

When the curved face 42 of the rotor 40 is in a range that is downstream from the outlet port 31*b* and upstream from the inlet port 31*a*, the passage 43 links the divided spaces 100*a* and 100*b*. When the curved face 42 of the rotor 40 is not in the aforementioned range, the divided spaces 100*a*, 101, and 100*b* are reliably separated by the separating member 50 and the rotor 40.

Like the separating member 50, the two sliding members 51*a* and 51*b* have a rectangular plane shape. However, the sliding members 51*a* and 51*b* are shorter, relative to the radial direction of the rotor 40, and thinner than the separating member 50. Furthermore, the members 51*a* and 51*b* are formed from synthetic resin, and consequently they have a lower coefficient of friction while sliding, with respect to the retaining groove 41, than the separating member 50. The separating member 50 is disposed within the retaining groove 41 while being sandwiched between the sliding members 51*a* and 51*b*. Consequently, the low coefficient of friction of the members 51*a* and 51*b* allows the separating member 50 to slide within the retaining groove 41 smoothly. Smooth sliding of the separating member 50 along the diameter of the rotor 40 secures tight contact between the protruding ends of the separating member 50 and the inner face 31*g*. The separating member 50 thus slides smoothly with respect to the housing member 31 while the rotor 40 is rotating. The separating member 50 also slides smoothly with respect to the base portion 31*c* and the cover member 60. The separating member 50 maintains tight contact with the inner faces defining the cavity 32 while the rotor 40 is rotating.

The cover member 60 is formed from synthetic resin by means of injection molding. As shown in FIG. 3, the cover member 60 has the sealing portion 61, a side portion 62, and a connecting portion 63. The sealing portion 61 is fitted tightly with an upper portion (upper relative to FIG. 3 of the housing member 31), and covers the cavity 32. The side portion 62 is cylindrical and extends from the sealing portion 61 to a lower end side, relative to FIG. 3, of the housing member 31, thus covering side faces of the housing member 31. The connecting portion 63 is formed at a lower end of the side portion 62 and extends horizontally in a collar shape. The cover member 60 is formed in a cap shape and covers an upper half of the housing member 31.

The sealing portion 61 corresponds to a top portion of the cap-shaped cover member 60, and has a plane disc shape. The concave shaft receiving portion 61*a*, in which the upper rotating shaft 40*a* of the rotor 40 can be supported, is formed in an inner side (the rotor 40 side) of the sealing portion 61.

As described earlier, the lower rotating shaft 40*b* of the rotor 40 is supported by the shaft receiving hole 31*j* of the housing member 31. The rotor 40 rotates while being supported from both axial sides. The rotational run-out of the rotor 40 is thus suppressed, this reducing the rotational load of the rotor 40 and thus increasing the output efficiency of the pump 30. Operating noise or vibration of the pump 30 is also reduced. Further, if the rotor 40 and the housing member 31 are maintained in the above positional relationship, ink can reliably be prevented from leaking between the divided spaces 100*a* and 100*b* that are separated by the rotor 40 and the separating member 50 (with the exception of the case where the passage 43 is formed by means of the curved face 42).

A ring-shaped concave groove 61*b* is formed along a periphery of the shaft receiving portion 61*a* of the sealing portion 61. The ring-shaped groove 61*b* is concave relative to the upwards direction of FIG. 3, and an upper end part of the cylindrical wall 31*h* of the housing member 31 is housed therein. A fitting face 61*c* is formed at an inner face of the concave groove 61*b*. An inner face of the upper end part of the cylindrical wall 31*h* of the housing member 31 fits tightly with the inner fitting face 61*c* of the cover member 60 and thus reliably prevents ink within the cavity 32 from leaking to the exterior.

The side portion 62 of the cover member 60 extends from an outer periphery of the sealing portion 61 to the fixing part 31*e* of the housing member 31, and covers the side face of the upper portion of the housing member 31. A resilient O ring 64 (a sealing member) is attached between the side portion 62 and the side face of the housing member 31. The O ring 64 reliably prevents ink from leaking out to the exterior of the pump 30 through the space between the side face of the housing member 31 and the side portion 62 of the cover member 60. The fitting face 61*c* is formed at the inner face of the concave groove 61*b* and fits tightly with the inner face of the upper end part of the housing member 31. There is consequently a uniform space between the side portion 62 and the housing member 31 along the entire circumference thereof. There is thus also a uniform degree of compression along the entire circumference of the O ring 64, and the seal created by the O ring 64 is consequently uniform. Furthermore, the elasticity of the O ring 64 exerts a diameter-increasing force upon the side portion 62. As a result, tensile force operates to increase the diameter of the fitting face 61*c* of the sealing portion 61. This results in the fitting face 61*c* being pushed uniformly onto the inner face of the upper end part of the housing member 31, resulting in the cover member 60 fitting uniformly with the inner circumference face of the housing member 31.

The plane face of the collar-shaped connecting portion 63 is formed in approximately the same shape as the fixing part 31*e* of the housing member 31, and is fixed to this fixing part 31*e* by means of the three screws 70 disposed at three equidistant locations along its circumference. Fixing the cap-shaped cover member 60 to the housing member 31 by means of these three equidistant screws 70 means that uniform force is operated upon the sealing portion 61, and the sealing portion 61 consequently fits tightly with the upper part of the housing member 31 along its entire circumference. Further, as shown in FIG. 3(*a*), when the cover member 60 is not fixed to the housing member 31, the connecting portion 63 is above the fixing part 31*e* and is separated therefrom by a minute space "d". The screws 70 extend parallel to the rotary shaft of the rotor, and the space "d" is reduced to zero when the connecting portion 63 and the fixing part 31*e* are brought together by means of tightening the screws 70. That is, when the cover member 60 is fixed to the housing member 31 by means of the three screws 70, the connecting portion 63 is pulled forcibly towards the fixing part 31*e* and is fixed thereto. As a result, a tensile force operates on the side portion 62, and a compressing force operates on the cylindrical wall 31*h* of the housing member 31. The sealing portion 61 is pushed against, and reliably fitted with, the upper end part of the housing member 31, thus reliably preventing ink in the cavity 32 from leaking to the exterior.

The upper end of the housing member 31 is open, and the inner face 31*g* of the cylindrical wall 31*h* of the housing member 31 can easily deviate from being circular due to distortion during molding, or the like. As shown in FIG. 3, the inner face of the upper end part of the cylindrical wall 31*h* is pushed into the fitting face 61*c* at the inner side of the concave groove 61*b* formed in the sealing portion 61. The inner face 31*g* thus follows the shape of the fitting face 61*c*. The shape of the cavity 32 within the housing member 31 is thus adjusted reliably. When the rotor 40 and the separating member 50 are rotating within the cavity 32, fluid cannot readily leak between the divided spaces 100*a*, 101, and 100*b* separated by the rotor 40 and the separating member 50 within the housing formed by the housing member 31 and the cover member 60. The housing structure is suitable for preventing the ink from leaking between the divided spaces 100*a*, 101, and 100*b* (with the exception of the case where the passage 43 is formed by means of the curved face 42 between the divided spaces 100*a* and 100*b*). The housing structure is also suitable for preventing the ink from leaking to the outside of the housing formed by the housing member 31 and the cover member 60.

Next, the operation of the pump 30 will be described.

Figure 6:
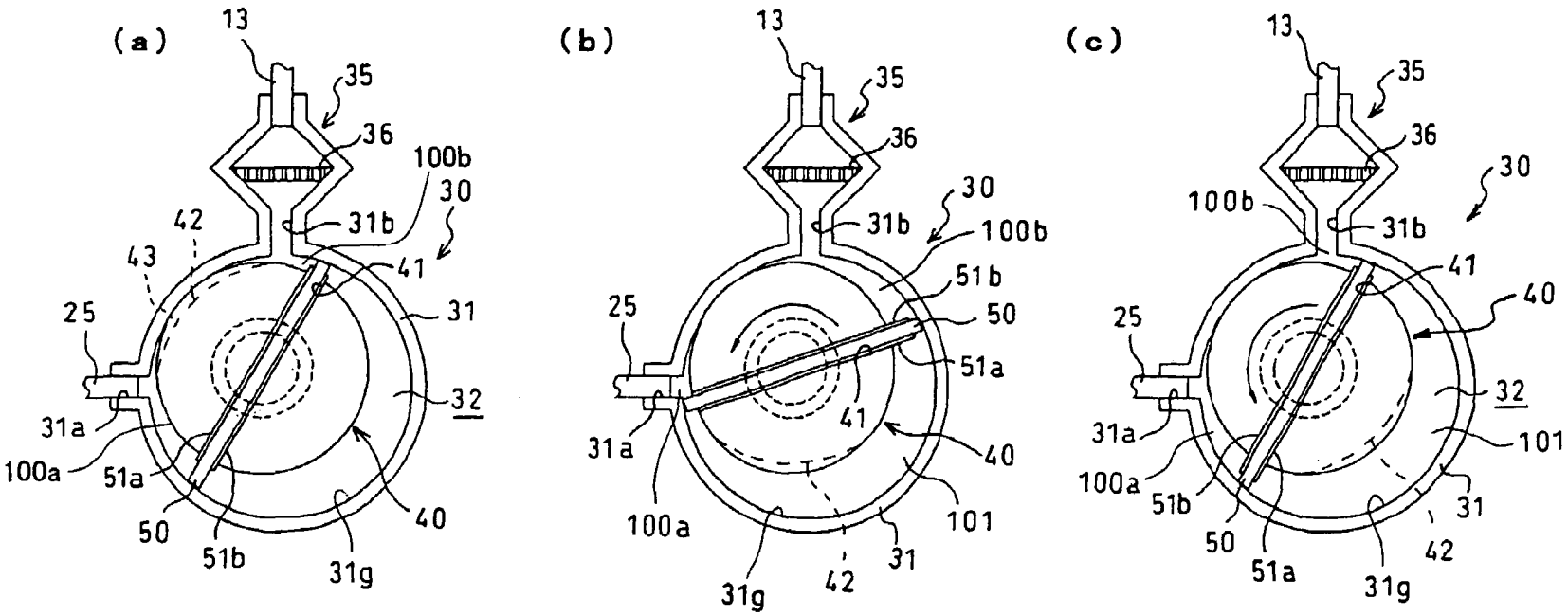
FIG. 6 shows the states of the pump during a printing operation and during a purging operation.

In the case where paper is being printed by means of the ink jet head 2, the stepping motor halts the rotor 40 of the pump 30 in the location of FIG. 6(*a*). The passage 43 is maintained between the curved face 42 of the rotor 40 and the inner face 31*g* of the housing member 31 when the pump 30 is halted, this passage 43 linking the inlet port 31*a* and the outlet port 31*b*. In this state, the ink in the ink cartridge 20 is supplied to the ink jet head 2 via the passage 43 in the pump 30 and via the tube 13, and the ink is discharged onto the paper from the nozzle of the ink jet head 2.

If the ink cartridge 20 has been changed, etc., an air bubble or the like may be entrapped in the ink. When this air bubble is to be expelled (purged), the driving force of the driving motor is transmitted to the rotor 40 via the gear 46 and the rotor 40 begins to rotate in an anti-clockwise direction from the state shown in FIG. 6(*a*). Thereupon, as shown in FIG. 6(*b*), the portion of the rotor 40 that does not have the curved face 42 makes contact with the inner face 31*g* of the housing member 31, and the passage 43 linking the inlet port 31*a* and the outlet port 31*b* is closed. The divided space 100*a* linked with the inlet port 31*a* and the divided space 100*b* linked with the outlet port 31*b* are separated by the rotor 40 that is making contact with the inner face 31*g*.

Furthermore, as shown in FIG. 6(*c*), when the rotor 40 rotates in the direction shown by the arrow, the divided space 100*a* linked with the inlet port 31*a* grows larger, the pressure of the ink within the divided space 100*a* decreases, and ink is consequently drawn therein from the ink cartridge 20. Conversely, as the rotor 40 rotates, the divided space 100*b* linked with the outlet port 31*b* grows smaller, the ink within the divided space 100*b* is compressed and is forced outwards from the outlet port 31*b* to the ink jet head 2. The ink in the ink cartridge 20 is thus forcibly delivered to the ink jet head 2 by means of the pump 30. Consequently, the air bubble trapped in the ink passage of the head main body 18 can be purged together with the ink.

As stated earlier, the amount of force required to rotate the rotor 40 changes depending on the angle of rotation of the rotor 40 with respect to the housing member 31. The passage 43 is maintained by forming the concave shape 42 in the outer peripheral surface of the rotor 40 along a limited angular region along the circumference direction. The angle of the location having this concave shape 42 with respect to the housing member 31 is thus changed while the rotor 40 is rotated, and the amount of force required to rotate the rotor 40 is thus changed depending on the angle of the location having the concave shape 42 with respect to the housing member 31.

Figure 7:
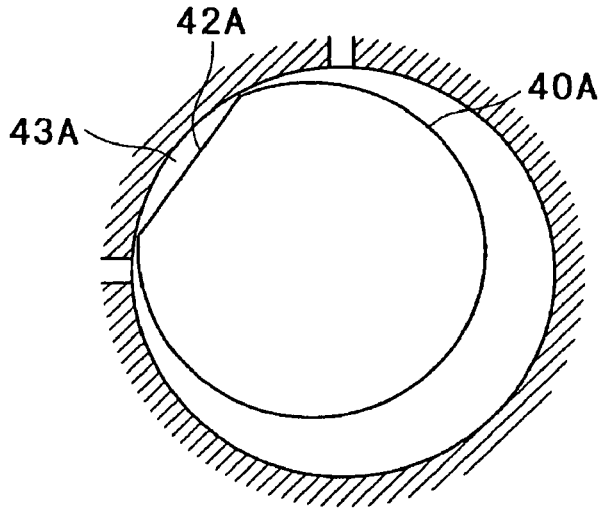
FIG. 7 shows a schematic view of a rotor provided with a plane cut-away portion.

As shown in FIG. 7, a passage 43A can be maintained by forming a plane cut-away portion 42A at the outer peripheral surface of the rotor 40A. If this is done, however, there is a rapid change in the amount of force required to rotate the rotor 40A depending on the angle of the location having the cut-away portion 42A with respect to the housing member 31. It is difficult for the rotor 40A to rotate smoothly, and the stepping motor driving the rotation of the rotor 40A can readily become out of step.

The above phenomenon is suppressed when the passage 43 is formed by the curved face 42 having a larger radius of curvature then the rotor 40. There is little change in the force required to rotate the rotor 40 while the angle of the cut-away portion 42 with respect to the housing member 31 is changed during the rotation of the rotor 40, and the rotor 40 can rotate smoothly. Since the stepping motor driving the rotation of the rotor 40 does not readily become out of step, the rotor 40 can rotate at high speed.

Further, if the passage 43 is formed by the curved face 42, there is little resistance in the passage 43 when the pump 30 is halted (the state shown in FIG. 6(*a*)). Consequently ink can be supplied smoothly to the ink jet head 2 while printing is being performed.

Figure 8:
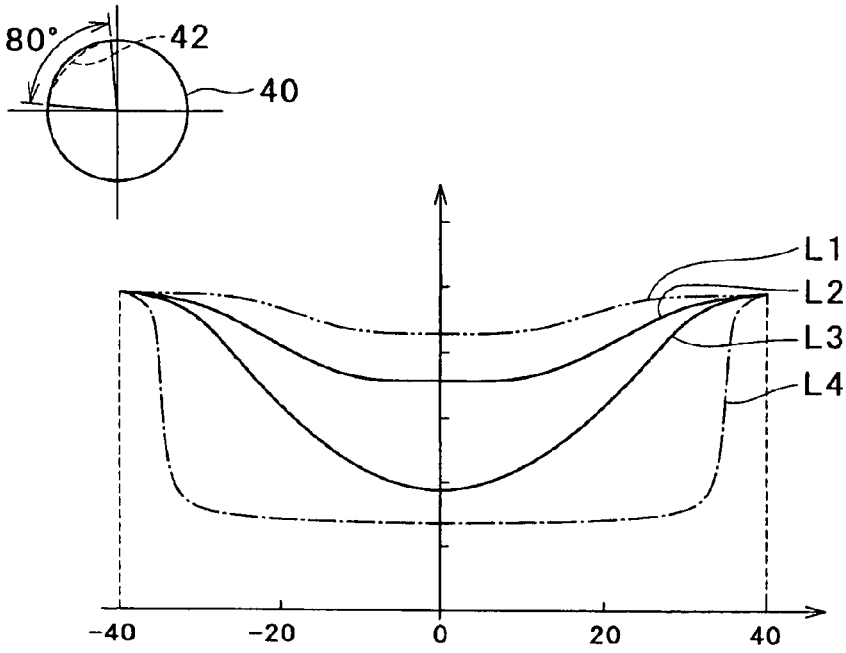
FIG. 8 shows the relationship between the rotational angle of the rotor and resistance in a passage.
Figure 8:
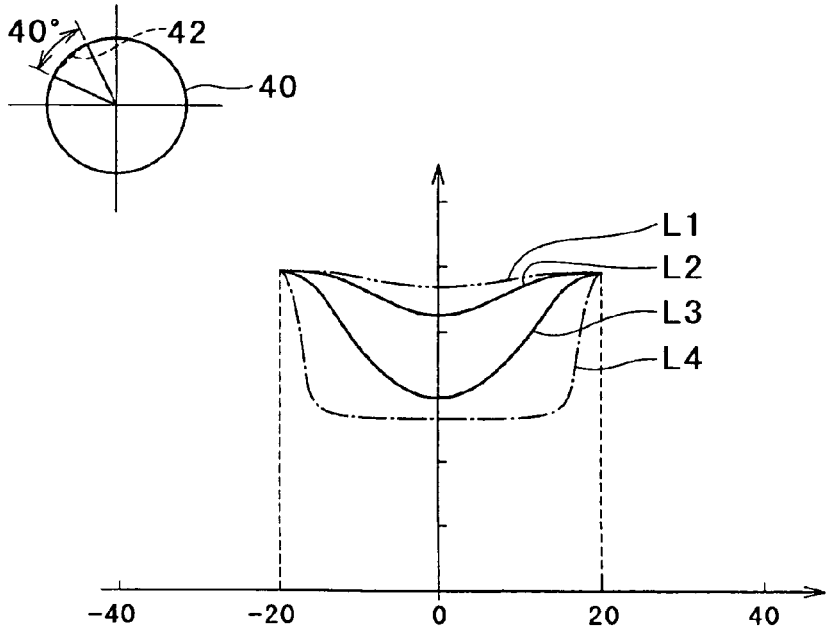
Figure 9:
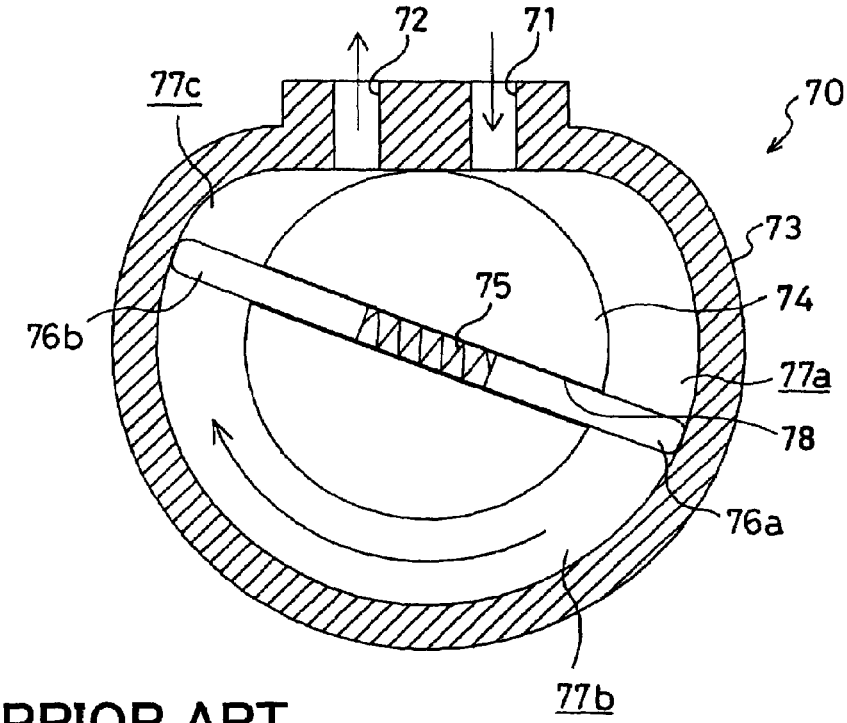
FIG. 9 shows a cross-sectional view of a conventional Cary's rotary pump.

Resistance in the passage 43 was measured in the case where the curved face 42 was formed across a divided region of 80° of the outer peripheral surface of the rotor 40. In the following, the radius of curvature of the rotor 40 is R, and the radius of curvature of the curved face 42 is r. The resistance in the passage from the inlet port 31*a* to the outlet port 31*b* was measured while the angle of rotation of the rotor 40 was varied (−40 to +40°). The results are shown in FIG. 8(*a*). A state in which the angle of rotation of the rotor 40 is 0° indicates that a central part, relative to the circumference direction, of the curved face 42 is nearest to the middle point of the inner face 31*g* of the housing member 31 between the inlet port 31*a* and the outlet port 31*b*, and the inlet port 31*a* and the outlet port 31*b* are linked (see FIGS. 4(*a*) and 6(*a*)). The angle of rotation of the rotor 40 is plus when in an anti-clockwise direction from the 0° state, and minus when in a clockwise direction from the 0° state. Further, in FIG. 8(*a*), a curve L1 shows a case where the radius of curvature r of the curved face 42 and the radius of curvature R of the rotor 40 are approximately identical (Almost no cut-away is formed). The curve L2 shows a case where the ratio r/R is 1.1, and the curve L3 shows a case where the ratio r/R is 1.3. The curve L4 is a line showing the relationship between the angle of rotation of the rotor and resistance in the passage for the case shown in FIG. 7, in which the plane cut-away portion 42A is formed in a rotor 40A. The specific values of resistance in the passage vary based on the radius of curvature r, the radius of curvature R and diameter of the rotor 40, as well as the inner diameter of the housing member 31. The specific values of resistance also change depending on the longitudinal length of the curved face 42, however, the longitudinal length of the curved face 42 does not have direct influence to the carved line shape between the resistance in the passage and the rotational angle of the rotor 40.

As shown in FIG. 8(*a*), in the case where the radius of curvature r of the curved face 42 and the radius of curvature R of the rotor 40 are approximately identical (L1, almost no cut-away is formed), resistance in the passage 43 is greater when the paper is to be printed (the passage being located where the angle is 0°). It is consequently difficult to supply a specified quantity of ink smoothly to the ink jet head 2 while the paper is being printed. In curve L4, this being the case where the passage 43A is formed by means of the plane cut-away portion 42A, (that is, r=infinity), there is too great a change of resistance in the passage, relative to the angle of rotation of the rotor 40A, when purging occurs. Consequently, there is the risk that the rotor 40A will rotate unevenly, that the motor will become out of step when the load on the driving motor changes greatly, and that the rotor 40A will stop rotating.

In the case where 1.1<r/R<1.3 (the range between the curves L2 and L3), there is less resistance in the passage 43 when the paper is to be printed. Consequently, it is easy to supply ink smoothly to the ink jet head 2 during printing. Further, there is a small change of resistance in the passage 43, relative to the change in angle of rotation of the rotor 40, during purging. The change in the load on the driving motor can be suppressed, and the motor does not readily become out of step. As a result, 1.1<r/R<1.3 is preferred.

If, for example, the ink supply destination is a 4 inch size ink jet head 2 at 600 dpi, ink viscosity is 3 cps, the diameter of the housing member 31 is 20 mm, the height of the rotor is 12 mm, R=8.7 mm, and r=10.6 mm, resistance in the passage is suppressed to 1.0 kPa/(ml/s), and there is no under-refilling (shortage of ink within the inkjet head that will be generated when the ink jet head injects greater amount of ink than the ink amount that is drawn into the ink jet head due to reduced pressure caused by the ink discharge), and no obstruction to the supply of ink during printing, etc. Furthermore, compression of 4.7 ml/s (the rotor 40 rotating at 14.6 rps) can be achieved during purging with a normal stepping motor of 40 square millimeter, and thus a current velocity can be obtained that allows efficient purging. Moreover, resistance required in the passage differs according to the size of the ink jet head 2 (the ink supply destination), frequency of ink discharge, or droplet quantity.

FIG. 8(*b*) shows the relationship between the angle of rotation of the rotor and resistance in the passage for the case where the curved face 42 is formed across a range of 40° of the outer periphery of the rotor 40. Even in the case where the resistance in the passage is required to be even smaller, if the angle forming the curved wall 42 is made smaller and is chosen from within the range in which r/R is 1.1 to 1.3, the resistance in the passage can be reduced to the value required, pump efficiency can be increased, and a well-balanced pump performance can be realized.

The following results are obtained using the pump described above.

The cap-shaped cover member 60 provided with the sealing portion 61 and the side portion 62 is fixed to the housing member 31 by means of the three screws 70 that are disposed equidistantly along the circumference direction. As a result, force is applied uniformly to the sealing portion 61 and this consequently fits tightly with the upper part of the housing member 31 along its entire circumference. Furthermore, when the cover member 60 is not fixed to the housing member 31, the connecting portion 63 is above the fixing part 31*e* and is separated therefrom by the minute space "d". When the cover member 60 is to be fixed to the housing member 31 by means of the three screws 70, the sealing portion 61 is pulled towards the upper part of the housing member 31, thus fixing the cover member 60 more reliably therewith. As a result, ink within the cavity 32 is reliably prevented from leaking to the exterior. Especially, the inner face of the upper end of the cylindrical wall 31*h* of the housing member 31 is pushed into the fitting face 61*c* at the inner side of the concave groove 61*b* of the cover member 60, and thus the inner face 31*g* follows the shape of the fitting face 61*c*. The shape of the cavity 32 within the housing member 31 is thus adjusted reliably into the predetermined shape. Therefore, ink can also reliably be prevented from leaking between the divided spaces 100*a*, 101, and 100*b* which are separated by the separating member 50 and the rotor 40. The efficiency of the pump 30 is thus increased.

The radius of curvature r of the curved face 42, this forming the passage 43 linking the inlet port 31*a* and the outlet port 31*b*, is greater than the radius of curvature R of the rotor 40. Consequently, during purging, there is a smaller rate of change in the resistance in the passage relative to the change in the angle of rotation of the rotor 40. As a result, there is a smaller change in the load on the rotor 40, and the rotor 40 can thus rotate smoothly. That is, the driving motor driving the rotation of the rotor 40 does not readily become out of step, and the rotor 40 can thus rotate at high speed. Further, while printing is being performed, there is little resistance in the passage 43 when the pump 30 is in a halted state, and ink can be supplied smoothly to the ink jet head 2.

Next, variations on the above embodiment will be described. Components configured identically to those of the above embodiment have the same reference numbers assigned thereto and a description thereof is omitted.

(1) The means for fixing the side portion 62 to the housing member 31 is not limited to the screws 70 of the above embodiment. For example, a cover member may be fixed to a housing member by fitting a connecting portion of the cover member with a fixing portion of the housing member. Alternatively, the side portion may be fixed irremovably to the housing member by bonding, welding, etc.

(2) The side portion of the cover member 60 needs not be cylindrical as in the above embodiment. For example, a plurality of side portions that are separated in a circumference direction may extend towards the fixing part 31*e* of the housing member 31. Furthermore, the side faces of the housing member may be covered entirely by the side portion. Moreover, a connecting portion of the cover member and a fixing portion of the housing member need not extend horizontally in a collar shape. Other shapes can be adopted as long as these shapes allow the cover member to fit with the fixing portion of the housing member.

(3) A curved face of the rotor may also extend along the entire length of the rotor in the axial direction thereof. In this case, forming the curved face in the rotor is easier.

(4) It is preferred that a curved face of the rotor is formed at a limited portion in an axial direction of the rotor. Specifically, it is preferred that the curved face of the rotor is formed along a limited distance in the middle of the rotor in the axial direction of the rotor. It is preferred that the rotor has complete circular cross sections at the upper and lower ends. The complete circular cross sections provide constant guide of the rotation of the rotor by the housing. This merit may be obtained even the cut-away is plane or flat.

The invention claimed is:

1. A pump comprising:

a housing having a cylindrical wall, a bottom wall provided at one end of the cylindrical wall, and a top wall provided at the other end of the cylindrical wall, wherein an inlet port and an outlet port are formed in the cylindrical wall;

a rotor installed within the housing; and a separating member to be rotated with the rotor, an edge of the separating member being in contact with an inner face of the housing, wherein an inner cavity of the housing is separated into a plurality of divided spaces by the separating member and the rotor, and the edge of the separating member slides along the inner face of the housing while the separating member is being rotated with the rotor;

wherein a curved face having a larger radius of curvature than the rotor is formed at a limited circumferential angular region at an outer peripheral surface of the rotor.

2. A pump of claim 1, wherein portions where the outer periphery of the rotor and the curved face intersect are formed in a curved face shape.

3. A pump of claim 1, wherein the ratio of r/R is $1.1<r/R<1.3$, in which r is the radius of curvature of the curved face, and R is the radius of curvature of the rotor.

4. A pump of claim 1, wherein the curved face is formed in a concave shape at middle portion in the outer peripheral surface of the rotor in the axial direction of the rotor.

5. A pump of claim 1 wherein corner portions between the concave shape having the larger radius of curvature and the circular outer surface of the rotor at both axial ends are formed, when observed in a cross-section that includes a rotary shaft of the rotor, with a prescribed radius of curvature.

6. A pump of claim 1, wherein the inlet port is linked with an ink cartridge, and the outlet port is linked with an ink jet head.

7. An ink jet printer, wherein the inlet port of the pump of claim 1 is linked with an ink cartridge, and the outlet port of the pump of claim 1 is linked with an ink jet head.

* * * * *